US009147980B2

(12) United States Patent
Chang et al.

(10) Patent No.: US 9,147,980 B2
(45) Date of Patent: Sep. 29, 2015

(54) ELECTRICAL CONNECTOR WITH SHIELD FRAME

(71) Applicant: HON HAI PRECISION INDUSTRY CO., LTD., New Taipei (TW)

(72) Inventors: Yen-Chih Chang, New Taipei (TW); Tzu-Yao Hwang, New Taipei (TW); Ke-Hao Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 6 days.

(21) Appl. No.: 14/071,643

(22) Filed: Nov. 4, 2013

(65) Prior Publication Data

US 2014/0322974 A1 Oct. 30, 2014

(30) Foreign Application Priority Data

Apr. 29, 2013 (TW) ..... 102115205 A

(51) Int. Cl.

| | |
|---|---|
| ***H01R 9/03*** | (2006.01) |
| ***H01R 13/6585*** | (2011.01) |
| *H01R 12/71* | (2011.01) |
| *H01R 13/24* | (2006.01) |
| *H01R 13/6474* | (2011.01) |

(52) U.S. Cl.

CPC ..... *H01R 13/6585* (2013.01); *H01R 12/714* (2013.01); *H01R 13/2442* (2013.01); *H01R 13/6474* (2013.01)

(58) Field of Classification Search

CPC ..... H01R 23/688; H01R 13/65807; H01R 23/005; H01R 23/7073; H01R 13/514

USPC ..... 439/607.5, 607.12, 607.13, 108, 607.1, 439/607.11, 66, 83

See application file for complete search history.

(56) References Cited

U.S. PATENT DOCUMENTS

| | | | | |
|---|---|---|---|---|
| 7,753,695 | B2 * | 7/2010 | Howell | 439/82 |
| 7,927,109 | B1 * | 4/2011 | Gattuso | 439/66 |
| 7,955,130 | B2 * | 6/2011 | Liu et al. | 439/607.09 |
| 8,475,179 | B2 * | 7/2013 | Lin et al. | 439/66 |
| 8,727,808 | B2 * | 5/2014 | Mason et al. | 439/607.05 |
| 2011/0159737 | A1 * | 6/2011 | Lin et al. | 439/626 |
| 2013/0017721 | A1 * | 1/2013 | Mason et al. | 439/607.08 |

* cited by examiner

*Primary Examiner* — Abdullah Riyami
*Assistant Examiner* — Thang Nguyen
(74) *Attorney, Agent, or Firm* — Wei Te Chung; Ming Chieh Chang

(57) ABSTRACT

An electrical connector includes an insulative housing having a number of walls formed with passageways thereof. An insulative cover defines a plurality of windows corresponding to the passageways. A shield frame has openings corresponding to the passageways and shield walls formed with the openings. A number of contacts are disposed in the passageways and have spring portions at upper portions. The shield frame is located between the insulative housing and the insulative cover. The spring portions of the contacts extend upwardly out of the openings and the windows.

19 Claims, 7 Drawing Sheets

ELECTRICAL CONNECTOR WITH SHIELD FRAME

BACKGROUND OF THE INVENTION

1. Field of the invention

The present invention relates to an electrical connector, and more particularly to the electrical connector having a shield frame to control or reduce electromagnetic interference (EMI) that occurs during operation of the electrical connector with the electronic package.

2. Description of Related Art

U.S. patent publication No. 20130017721 issued to Mason et al. on Jan. 17, 2013 discloses an electrical connector assembly including an interposer having a side surface and an array of electrical contacts exposed along the side surface. The electrical contacts are located within a contact region that extends along the side surface. The electrical contacts are configured to engage an electronic module mounted on the contact region. The connector assembly also includes a shield wall that is attached to and extends along the side surface. The shield wall separates the contact region into shielded sub-regions. The shield wall includes a conductive material and is electrically coupled to an interposer. At least one electrical contact is located within the shielded sub-region. The shield wall extends between adjacent electrical contacts to shield the adjacent electrical contacts from electromagnetic interference. However, the shield wall exposed to exterior can lead short circuit with other electrical elements.

Therefore, an improved electrical connector is needed.

SUMMARY OF THE INVENTION

An object of the present invention is to provide an electrical connector to control or reduce electromagnetic interference (EMI) that occurs during operation of the electrical connector with the electronic package.

According to one aspect of the present invention, an electrical connector comprises an insulative housing having a plurality of walls formed with passageways thereof. An insulative cover defines a plurality of windows corresponding to the passageways. A shield frame has openings corresponding to the passageways and shield walls formed with the openings. A plurality of contacts are disposed in the passageways and have spring portions at upper portions. The shield frame is located between the insulative housing and the insulative cover. The spring portions of the contacts extend upwardly out of the openings and the windows.

According to another aspect of the present invention, an electrical connector comprises an insulative housing having a plurality of walls formed with passageways thereof. An insulative cover defines a plurality of windows corresponding to the passageways. A shield frame has a similar walls and passageways with the insulative cover and is located between the insulative housing and the insulative cover.

Other objects, advantages and novel features of the invention will become more apparent from the following detailed description of a preferred embodiment when taken in conjunction with the accompanying drawings.

DETAILED DESCRIPTION OF THE INVENTION

Figure 1:
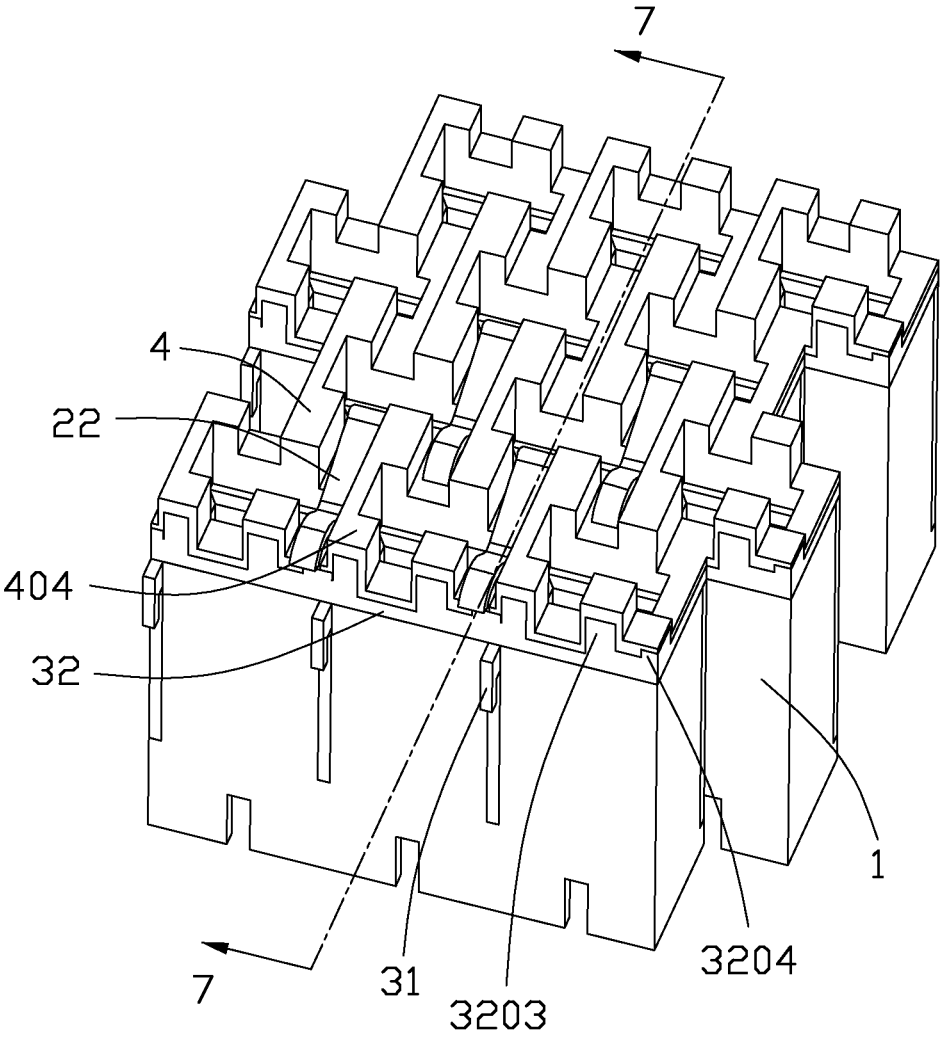
FIG. 1 is an assembled, perspective view of an electrical connector in accordance with the present invention.
Figure 2:
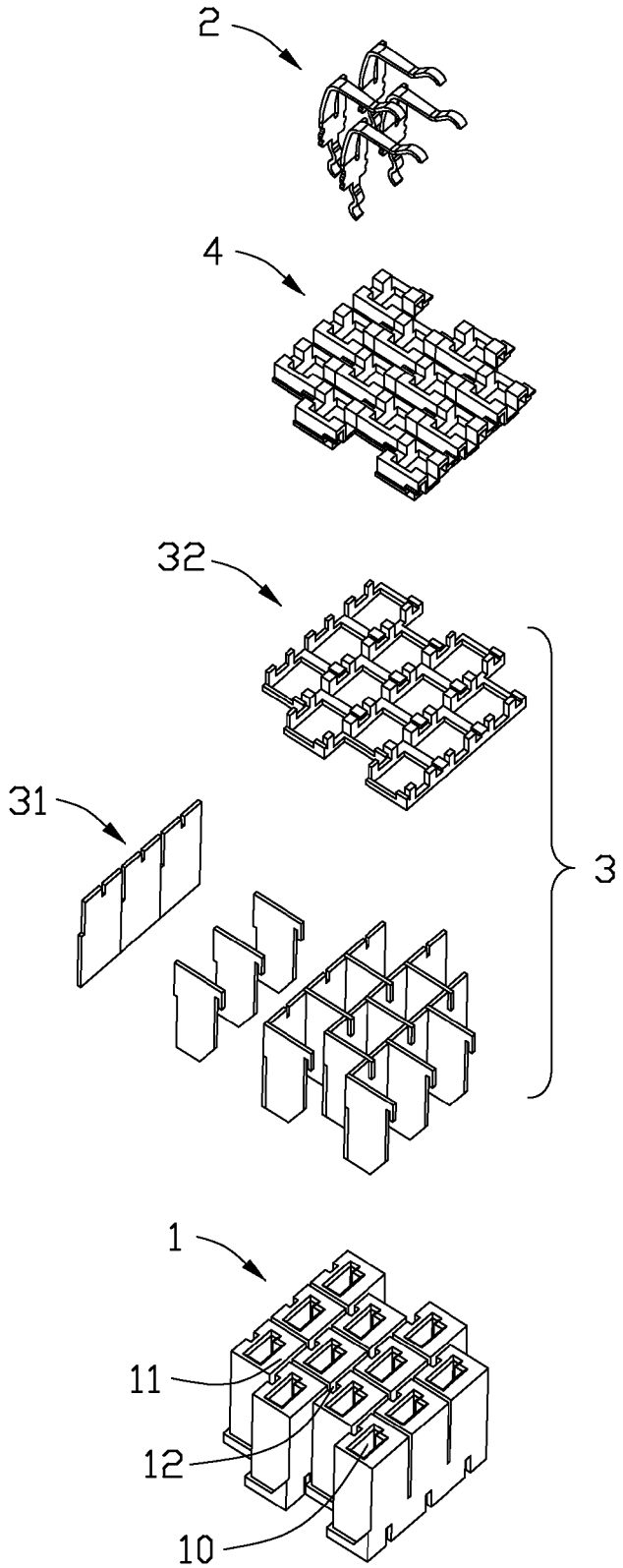
FIG. 2 is an exposed, perspective view of the electrical connector shown in FIG. 1.

Referring to FIGS. 1 to 2, an electrical connector used for electrically connecting an electronic package (not shown) and a printed circuit board (PCB, not shown), comprises an insulative housing 1, a plurality of contacts 2 received in the insulative housing 1, a shield device 3 and an insulative cover 4. The shield device 3 includes shield walls 31 mounted in the insulative housing 1 and a shield frame 32 mounted upon the insulative housing 1. The shield plates 31 and the shielding frame 32 are configured to control or reduce electromagnetic interference (EMI) that occurs during operation of the electrical connector with the electronic package.

Figure 3:
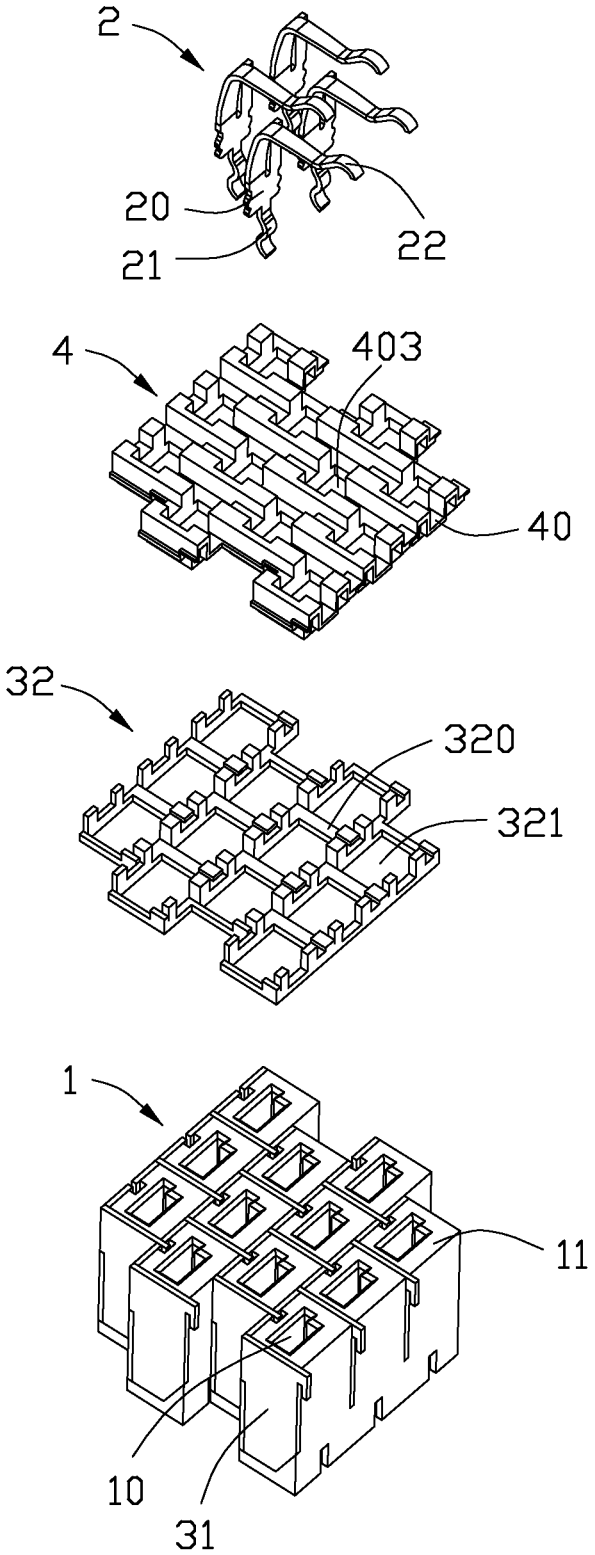
FIG. 3 is a partial exposed view of the electrical connector.

Referring to FIGS. 2 and 3, the insulative housing 1 has a plurality of walls 11 formed a plurality of passageways 10 to receive the contacts 2. The passageways 10 are staggered in two neighboring rows to allow the contacts 2 located in behind row extending across the front row. Each contact 2 includes a retention portion 20 mounted in the passageway 10, a soldering portion 21 extending from the retention portion 20, and a spring portion 22 extending upon an upper surface of the insulative housing 1. Each contact 2 is surrounded by channels 12 defined on the walls 11 of the insulative housing 1. The shield plates 31 is made of metallic material and mounted in the channels 12.

Figure 4:
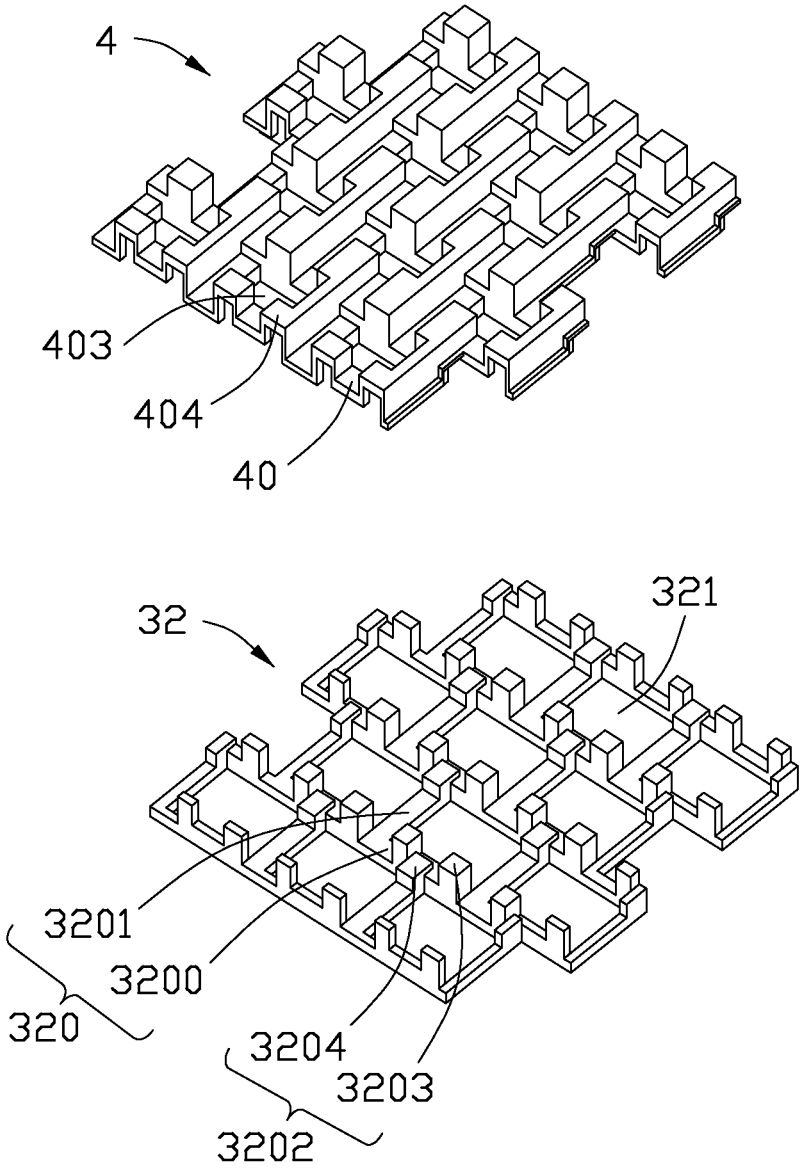
FIG. 4 is an exposed view of a shield frame and insulative cover.

Referring to FIG. 4, the shield frame 32 is made of metallic material. The shield frame 32 having a structure corresponding to the insulative housing 1, includes shield walls 320 corresponding to the walls 11 and openings 321 corresponding to the passageways 10. The shield walls 320 are mounted upon the walls 11 of the insulative housing 1 and directly engage with the shield plates 31. The shield walls 320 include longitudinal walls 3201 and transverse walls 3200 perpendicular to the longitudinal walls 3201. A plurality of protrusions 3202 are disposed on the transverse walls 3200 and near the crossing position. The protrusions 3202 includes lower protrusions 3204 and higher protrusions 3203 higher than the lower protrusions 3204, and each lower protrusion 3204 located between a pair of higher protrusions 3203.

Figure 5:
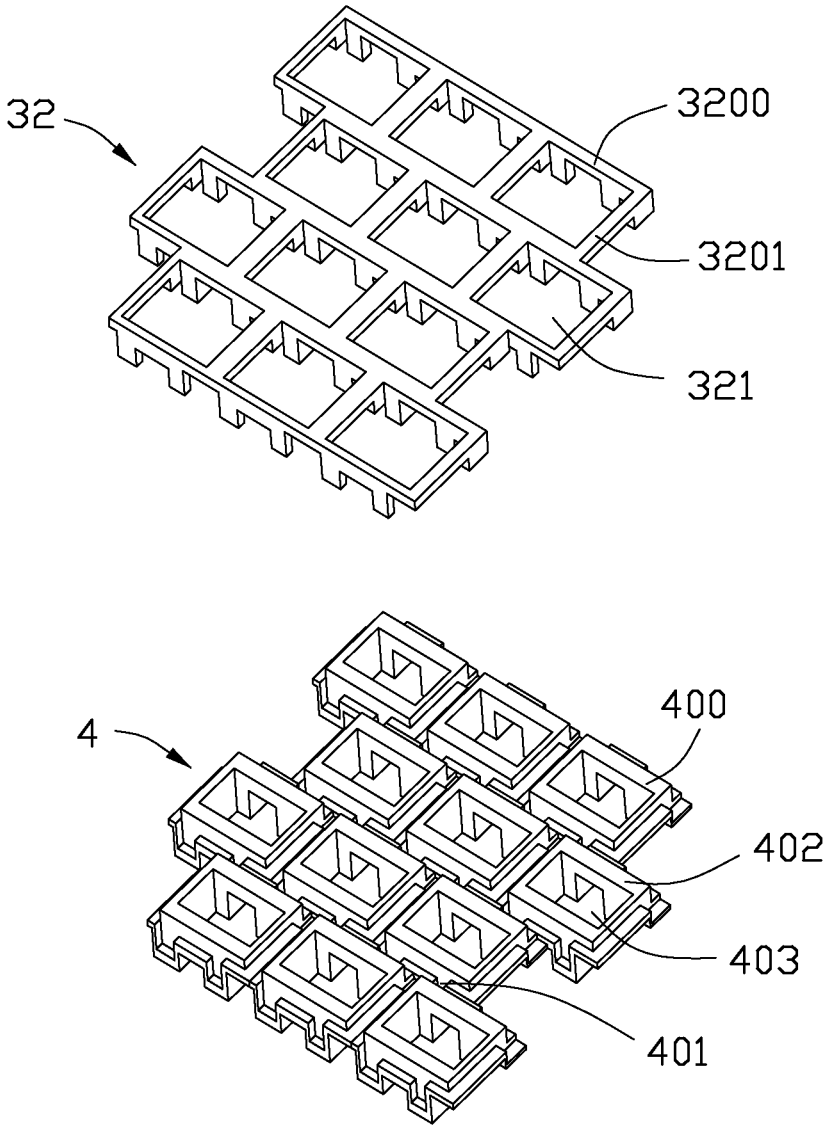
FIG. 5 is another view showed in FIG. 4.

Referring to FIG. 4 and FIG. 5, the insulative cover 4 has an insulative body 40 defining a recess 401 at a bottom surface 400 thereof for receiving and covering the shield frame 32 to protect the spring portions 22 of the contacts 2 from short circuit with the shield frame 32. The insulative cover 4 and the shield frame 32 have flush bottom surfaces and are both located on the insulative housing 1. The insulative cover 4 is divided into a plurality of cover units 402 each having a window 403 in the center for allowing the spring portion 22 of the contact 2 passing therethrough. A plurality of blocks 404 extend upwardly from top side of the insulative cover 4 and are located at two opposite sides of the spring portions 22 for short circuit. In this embodiment, the higher protrusions 3203 is mounted at the bottom of the blocks 404 for reduce the profile of the electrical connector.

Figure 6:
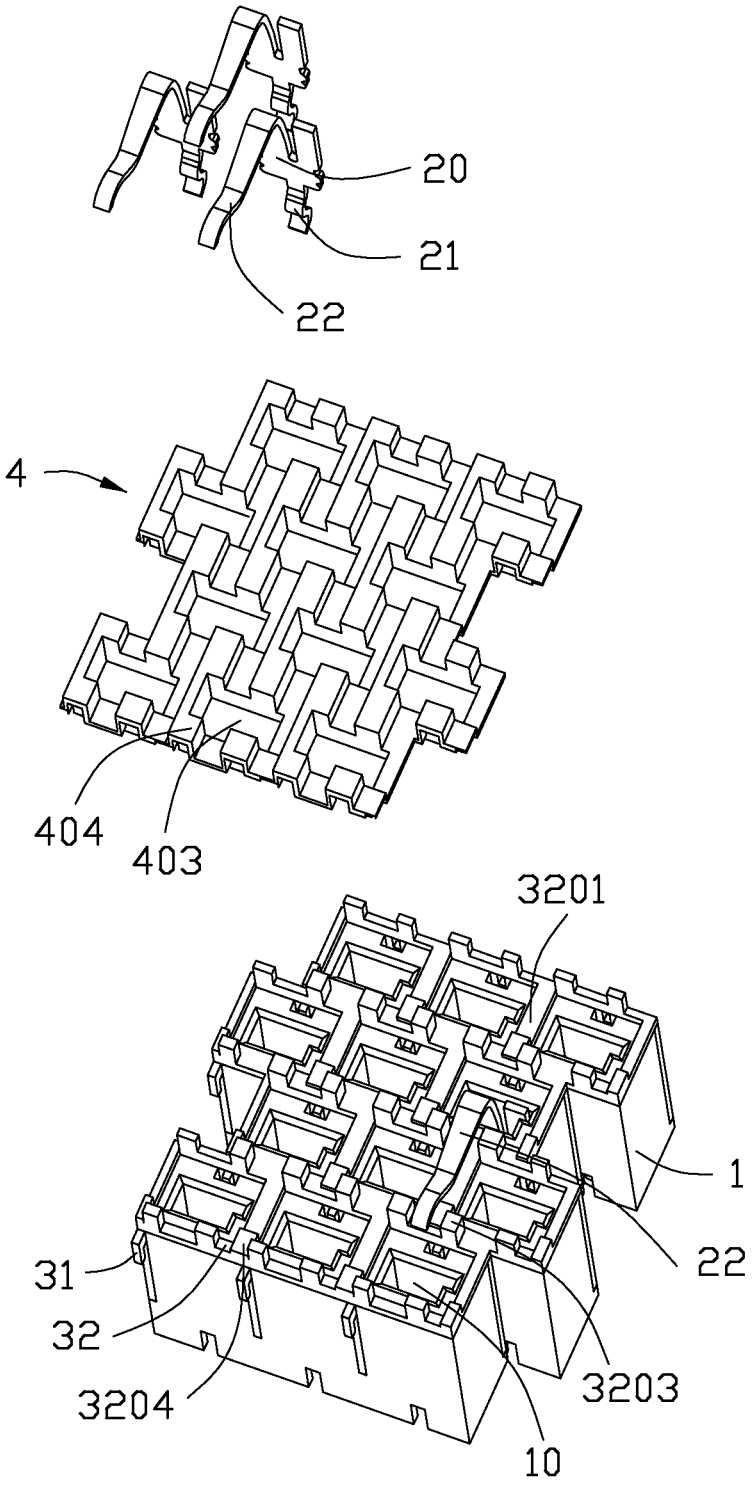
FIG. 6 is another partial exposed view of the electrical connector.
Figure 7:
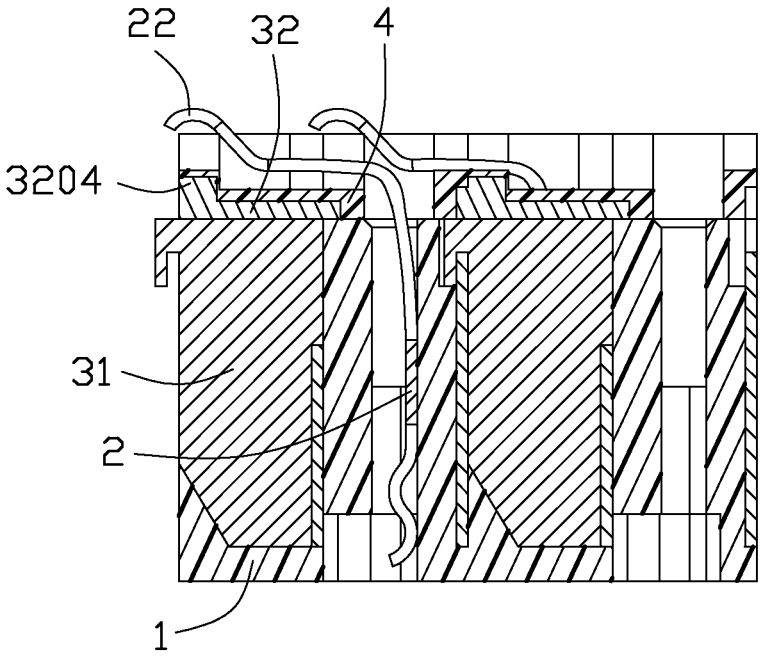
FIG. 7 is a cross-sectional view taken along line 7-7 of FIG. 1.

FIG. 6 shows the contact 2 (omitted other contacts) disposed in the insulative housing 1 and the shield frame 32. The spring portions 22 of the contact 2 extend along the longitudinal walls 3201 and are surrounded by higher protrusions 3203 at two sides of the root and the free end of the spring portions 22. The lower protrusion 3204 is disposed below the free end of the spring portion 22. In this embodiment, the shield frame 32 having longitudinal walls 3201, higher protrusions 3203 and lower protrusions 3204 changes the resonance mode of electromagnetic wave to reduce the near end cross talk for the spring portions 22.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing having a plurality of walls formed a plurality of passageways thereof;

an insulative cover located above the insulative housing and defining a plurality of windows corresponding to the passageways;

a shield frame having openings corresponding to the passageways and shield walls formed with the openings;

a plurality of contacts disposed in the passageways and having spring portions at upper portions; and wherein the shield frame is located vertically between the insulative housing and the insulative cover, and the spring portions of the contacts extend upwardly out of the openings and the windows.

2. The electrical connector as claimed in claim 1, wherein the shield frame is covered by the insulative cover and is flush with insulative cover at bottom portion.

3. The electrical connector as claimed in claim 1, wherein at least part of the shield walls of the shield frame is located at a region formed below the spring portions.

4. The electrical connector as claimed in claim 1, wherein the shield walls include longitudinal walls staggered in two neighboring rows and transverse wall perpendicular to the longitudinal walls.

5. The electrical connector as claimed in claim 4, wherein the spring portion of the contact extends along the longitudinal wall.

6. The electrical connector as claimed in claim 4, wherein a plurality of protrusions are disposed at the transverse walls and near the crossing position formed by the transverse walls and longitudinal walls.

7. The electrical connector as claimed in claim 6, wherein the protrusion includes a pair of higher protrusions located at two opposite sides of the spring portion and a lower protrusion located just below the spring portion.

8. The electrical connector as claimed in claim 1, wherein the insulative cover has a plurality of blocks extending upwardly from a top side thereof and located at two opposite sides of the spring portions.

9. The electrical connector as claimed in claim 1, wherein a bottom surface of the insulative cover defines a recess to receive the shield frame.

10. An electrical connector comprising:

an insulative housing having a plurality of walls formed with passageways thereof;

an insulative cover located above the insulative housing and defining a plurality of windows corresponding to the passageways;

a shield frame having similar walls and passageways with the insulative cover and being located vertically between the insulative housing and the insulative cover.

11. The electrical connector as claimed in claim 10, wherein the shield frame is made of metallic material.

12. The electrical connector as claimed in claim 10, wherein the shield frame includes a plurality of lower protrusions and higher protrusions.

13. The electrical connector as claimed in claim 10, wherein the shield cover has a recess to receive the shield frame and is flushed with the shield frame.

14. An electrical connector comprising:

an insulative housing defining a plurality of passageways extending there through in a matrix manner;

a plurality of channels surrounding the corresponding passageways, respectively, in a grid manner;

a plurality of metallic shielding layers disposed in the corresponding channels to circumferentially shielding the passageways;

a metallic shielding frame arranged in the grid manner to mechanically and electrically contact the corresponding shielding layers therein in a shielding manner along a vertical direction, a plurality of upward protrusions formed on the shielding frame; and a plurality of contacts each having a main body retained in the corresponding passageway and a resiliently contacting section extending upwardly and obliquely above the shielding frame; wherein said shielding layer is discrete from the corresponding channel.

15. The electrical connector as claimed in claim 14, further including an insulative cover compliantly covering the shielding frame in the vertical direction so as to assure isolation between the shielding frame and the corresponding contacting sections of the contacts.

16. The electrical connector as claimed in claim 15, wherein said insulative cover is discrete from said shielding frame.

17. The electrical connector as claimed in claim 15, wherein said insulative cover further covers the shielding frame transversely.

18. The electrical connector as claimed in claim 14, wherein the shielding frame includes a plurality of lower protrusions and higher protrusions.

19. The electrical connector as claimed in claim 14, wherein the insulative cover has a plurality of blocks extending upwardly from a top side thereof and located at two opposite sides of the contacting sections.

* * * * *